US006551094B2

(12) United States Patent
Fastnacht et al.

(10) Patent No.: US 6,551,094 B2
(45) Date of Patent: Apr. 22, 2003

(54) METHOD AND DEVICE FOR DETERMINING A SOOT CHARGE IN A COMBUSTION CHAMBER

(75) Inventors: Felix Fastnacht, Erlangen (DE); Thomas Merklein, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 89 days.

(21) Appl. No.: 09/803,764

(22) Filed: Mar. 12, 2001

(65) Prior Publication Data

US 2001/0019814 A1 Sep. 6, 2001

Related U.S. Application Data

(63) Continuation of application No. PCT/DE99/02839, filed on Sep. 8, 1999.

(30) Foreign Application Priority Data

Sep. 11, 1998 (DE) ..... 198 41 877

(51) Int. Cl.[7] ..... F23N 5/08

(52) U.S. Cl. ..... 431/2; 431/76; 374/36; 250/554; 702/23

(58) Field of Search ..... 431/2, 12, 76, 431/79; 110/185, 191; 700/274; 250/554, 339.15; 73/23.31, 23.33; 356/315, 417; 702/23, 26, 28, 29, 30; 374/31, 36, 110, 141

(56) References Cited

U.S. PATENT DOCUMENTS 4,620,491 A 11/1986 Nishikiwa et al.
5,249,954 A * 10/1993 Allen et al. ..... 431/76
5,551,780 A * 9/1996 Wintrich et al. ..... 374/45
5,575,637 A * 11/1996 Slavejkov et al. ..... 431/8
5,794,549 A 8/1998 Carter
5,797,736 A * 8/1998 Mengüc et al. ..... 431/2
5,829,962 A * 11/1998 Drasek et al. ..... 431/12
5,971,747 A * 10/1999 Lemelson et al. ..... 431/76

FOREIGN PATENT DOCUMENTS

| | | | | |
|---|---|---|---|---|
| DE | 29 50 689 A1 | | 6/1981 | |
| DE | 29 50 690 A1 | | 6/1981 | |
| DE | 40 38 640 A1 | | 6/1991 | |
| DE | 195 32 539 A1 | | 3/1997 | |
| DE | 196 05 287 A1 | | 8/1997 | |
| DE | 19931111 A1 | * | 1/2001 | |
| EP | 616200 A1 | * | 9/1994 | |
| JP | 60-196517 A | * | 10/1985 | ..... 431/31 |
| JP | 61-138022 A | * | 6/1986 | |
| JP | 62-276326 A | * | 12/1987 | ..... 431/79 |
| JP | 3-207912 A | * | 9/1991 | |

OTHER PUBLICATIONS

Japanese Patent Abstract No. 62276326, dated Dec. 1, 1987.

* cited by examiner

*Primary Examiner*—Sara Clarke
(74) *Attorney, Agent, or Firm*—Laurence A. Greenberg; Werner H. Stemer; Ralph E. Locher

(57) ABSTRACT

A method for determining a soot charge in a combustion chamber includes measuring a spatial distribution of at least one parameter characteristic of a combustion by monitoring a flame in the combustion chamber. The at least one parameter allows a conclusion concerning a soot charge in the combustion chamber during operation and the at least one parameter is a temperature and/or a carbon monoxide content. The soot charge is determined based on the measuring step and by using a comparison with given conversion curves. A device for determining a soot charge in a combustion chamber is also provided.

21 Claims, 3 Drawing Sheets

METHOD AND DEVICE FOR DETERMINING A SOOT CHARGE IN A COMBUSTION CHAMBER

CROSS-REFERENCE TO RELATED APPLICATION

This application is a continuation of copending International Application No. PCT/DE99/02839, filed Sep. 8, 1999, which designated the United States.

BACKGROUND OF THE INVENTION

Field of the Invention

The invention relates to a method and to a device for determining the soot charge in a combustion chamber during operation.

In the past there has been a continuous effort towards improving the process of burning fossil fuel in a combustion chamber. This holds not only for gaseous pollutants such as carbon monoxide and nitrogen oxides, but also for solid pollutants, such as soot, in the exhaust gas. In order to achieve an optimized combustion process, the firing must be optimized by using a suitable firing control. Specifically, when fossil fuel or refuse is burned, there are fluctuations in the calorific value of the fuel or the refuse mixture because of the different origin of the fuel or of the heterogeneous composition of the refuse. Moreover, when using fuel mixtures, a ratio of the individual fuels in the fuel mixture can fluctuate.

One possibility of optimization is to determine the soot charge or soot load during operation, the soot charge determined subsequently being used to control the flame. A known procedure uses a punctiform extraction of exhaust gases having soot fractions with the aid of an extracting probe. The extraction can be performed either in the combustion chamber or in a downstream exhaust gas system. Subsequently, the extracted air quantity is examined and the soot charge is determined thereby. It is impossible to provide a complete detection of the soot charge with this procedure, since extraction is performed only in a punctiform fashion. Local fluctuations in the soot charge in the combustion chamber or in the exhaust gas system therefore lead to a distorted detection result. Moreover, the soot charge produced during combustion is not detected until after a certain delay time. The firing control provided therefore always operates with a comparatively large dead time, which can be up to a few minutes in the case of relatively large power plants.

Another approach determines the soot charge of flames with the aid of laser absorption measurements using the Mie theory. This measuring method is, however, suitable only for research purposes in the laboratory, since the measurement of the soot charge in a flame is very complicated. It is currently impossible to use it in daily continuous operation.

U.S. Pat. No. 5,797,736 describes a method and a device through the use of which formation of a flame in a combustion process is controlled. In this case, sensors are used which detect characteristic parameters of combustion in and near the flame such as, for example, the temperature, the distribution of particles etc.

However, it is not stated in more detail in U.S. Pat. No. 5,797,736 how, for example, a soot charge in a combustion chamber is determined quantitatively. The main goal is to detect in the flame qualitative irregularities—such as, for example, fluctuations in the temperature distribution of the flame ("cooler spots") which can be caused, inter alia, by an irregular distribution of combustion particles—in order to align a configuration of beam reflectors such that radiant energy of the flame is reflected specifically onto "cooler spots" inside the flame. This renders the combustion more uniform.

A quantitative determination of the soot charge in a combustion chamber is not possible with the aid of the last-named method and device.

SUMMARY OF THE INVENTION

It is accordingly an object of the invention to provide a method and a device for determining a soot charge which overcome the above-mentioned disadvantages of the heretofore-known methods and devices of this general type and which allow a quick and simple determination of the soot charge in a combustion chamber during operation.

With the foregoing and other objects in view there is provided, in accordance with the invention, a method for determining a soot charge in a combustion chamber, the method includes the steps of:

measuring a spatial distribution of at least one parameter characteristic of a combustion by monitoring a flame in the combustion chamber, the at least one parameter allowing a conclusion concerning a soot charge in the combustion chamber during operation and the at least one parameter being at least one of a temperature and a carbon monoxide content; and determining the soot charge based on the measuring step and by using a comparison with given conversion curves.

In other words, the object of the invention is achieved by virtue of the fact that the spatial distribution of the temperature, and/or the content of carbon monoxide is measured as a parameter characteristic of the combustion, and the soot charge or soot load is determined by comparison with given conversion curves.

Such conversion curves are available in printed form for various fuels, for example in the "VDI-Wärmeatlas" ["VDI Heat Atlas"] and in "Technische Verbrennung" ["Technical Combustion"], Warnatz, Springer-Verlag [Warnatz, Springer-Publisher]. Alternatively, or in addition, these conversion curves can be determined by experiments on different fuels or fuel compounds and stored in the form of a characteristic diagram.

The spatial distribution of the temperature can be detected by one or more suitable sensors. The measurement is accurate and contactless and requires no moving parts and is performed without delay. The content of carbon monoxide is measured, for example, by detecting the radiation in the radiation region characteristic of carbon monoxide. This radiation region is, for example, isolated from the overall spectrum of the flame by a beam splitter and subsequently detected; a suitable evaluation unit for the spatial distribution of the carbon monoxide is, for example, a CCD (charge-coupled device) camera.

The invention proposes to replace the previously known direct method for determining the soot charge or soot load by an indirect method. It is possible to avoid extracting soot-charged exhaust gases or an expensive direct determination of the soot charge in the flame. Rather, a simple measurement is used to detect parameters characteristic of a combustion, and the soot charge is determined subsequently on the basis of this measurement and on comparison with given conversion curves. There is no need for expensive extraction and analysis devices. Furthermore, the determination of the soot charge is performed according to the invention without a time delay, and thus an optimum firing control can be achieved.

By comparison with a one-dimensional measurement, more accurate determination of the soot charge is possible by measuring the spatial distribution of the temperature and/or the content of carbon monoxide, since both variables are generally not constant in the region of the flame.

Furthermore, in the case of turbulent combustion which is always present in the combustion chamber of power plants, the position of the flame changes during combustion. A stationary measurement at individual selected points could lead to the flame not being detected by the measuring device when varying its position. This can be prevented when detecting the spatial distribution by prescribing a spatial measuring zone.

In an advantageous embodiment it is possible to prescribe for the measured values a permissible range with a lower limit and/or upper limit. If a measured values lies outside the prescribed range, it cannot be taken into account when determining the soot charge. A lower limit of, for example, 800° C. can, for example, be set when measuring the temperature. Ranges in which the temperature lies below this limit can then be regarded as lying outside the flame and be left out of account when determining the soot charge.

In an advantageous embodiment, the local soot formation rate is determined based on the measured spatial distribution of the temperature and/or the content of carbon monoxide. This means that the local formation rate associated with one or more discrete locations inside the spatial measuring zone is determined from the discrete measured values, associated with the discrete location, of the temperature and/or the content of carbon monoxide, the discrete measured values, associated with the discrete location, of the temperature and/or the content of carbon monoxide being taken from the spatial distribution of the measured values. The measuring accuracy is improved thereby.

Advantageously, the local soot formation rate is calculated using physical and/or chemical relationships. The local soot formation rate can be determined thereby without prior tests and empirical values by prescribing the fuel or the fuel mixture.

The determined soot formation rate is advantageously summed over the measuring zone. This reduces the data volume to be processed. At the same time, a total value for the soot formation rate results which can already be used for monitoring and control purposes.

In accordance with an advantageous embodiment, the determined soot formation rate is summed over a prescribeable time interval. Fluctuations in the flame, in particular due to turbulent combustion, can be reliably detected. Peak values or minimum values are simultaneously smoothed. Moreover, the flame can be monitored or controlled by the summing. If the flame extinguishes, the soot formation rate drops drastically for a relatively long time interval. Short-term flickering is smoothed by the summing over the prescribeable time interval, while extinction of the flame leads to a permanent drop in the soot formation rate which can be detected by the method according to the invention. It is therefore also possible to monitor the flame in addition to determining the soot charge.

In an advantageous embodiment, the prescribeable time interval is variable. In particular, this time interval can be varied as a function of preceding measurements. Furthermore, the prescribeable time interval can be selected otherwise than in unchanging continuous operation when starting up or in the case of load fluctuations.

The determined soot formation rate is advantageously averaged after the summing. This averaging permits the soot formation rate to be represented with reference to the magnitude of the measuring zone such that a plurality of flames or combustion chambers of different size can be compared with one another.

In accordance with an advantageous embodiment, the determined soot formation rate is, before or after the summing, linked to a calibration factor determining the soot charge. This calibration factor permits the inference from the soot formation rate to the soot charge, and is determined in a fashion specific to the boundary.

The calibration factor is advantageously variable, in particular as a function of the measured value, the combustion air fed to the flame and/or other parameters. Adaptation to different boundary conditions is thereby achieved.

It is advantageous for both the temperature and the carbon monoxide content to be measured and linked to one another. This procedure permits the soot charge to be determined on the basis of two different measured values, and thus permits a control. The accuracy is raised at the same time.

With the objects of the invention in view there is also provided, a device for determining a soot charge in a combustion chamber, including:

at least one sensor for measuring a spatial distribution of at least one parameter characteristic of a combustion by monitoring a flame in a combustion chamber, the at least one parameter allowing a conclusion concerning a soot charge in the combustion chamber and the at least one parameter being a temperature and/or a carbon monoxide content; and a data processing device operatively connected to the at least one sensor, the data processing device determining a soot formation rate based on the spatial distribution of the at least one parameter and based on a comparison with given conversion curves.

In other words, according to the invention, a device for carrying out the method has at least one sensor for measuring the spatial distribution of the temperature and/or the content of carbon monoxide, and a data processing device for determining the soot formation rate. The data processing device includes, in particular, suitable subassemblies or modules for summing and averaging the soot formation rate and for linking with the calibration factor.

At least one sensor is advantageously configured as a CCD camera. Such "charge-coupled device" cameras permit local resolution of the measuring zone, and thus detection of the at least one parameter characteristic of combustion, in a spatial distribution.

The determined soot formation rate can subsequently be processed further via a suitable controller and provided to the flame burner.

With the objects of the invention in view there is also provided, in combination with a combustion chamber having a soot charge during operation, a device for determining the soot charge, including:

at least one sensor configured for measuring a spatial distribution of a temperature and/or a carbon monoxide content in the combustion chamber by monitoring a flame in the combustion chamber; and a data processing device operatively connected to the at least one sensor, the data processing device determining a soot formation rate based on the spatial distribution of the temperature and/or carbon monoxide content and based on a comparison with given conversion curves.

Other features which are considered as characteristic for the invention are set forth in the appended claims.

Although the invention is illustrated and described herein as embodied in a method and a device for determining the soot charge in a combustion chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
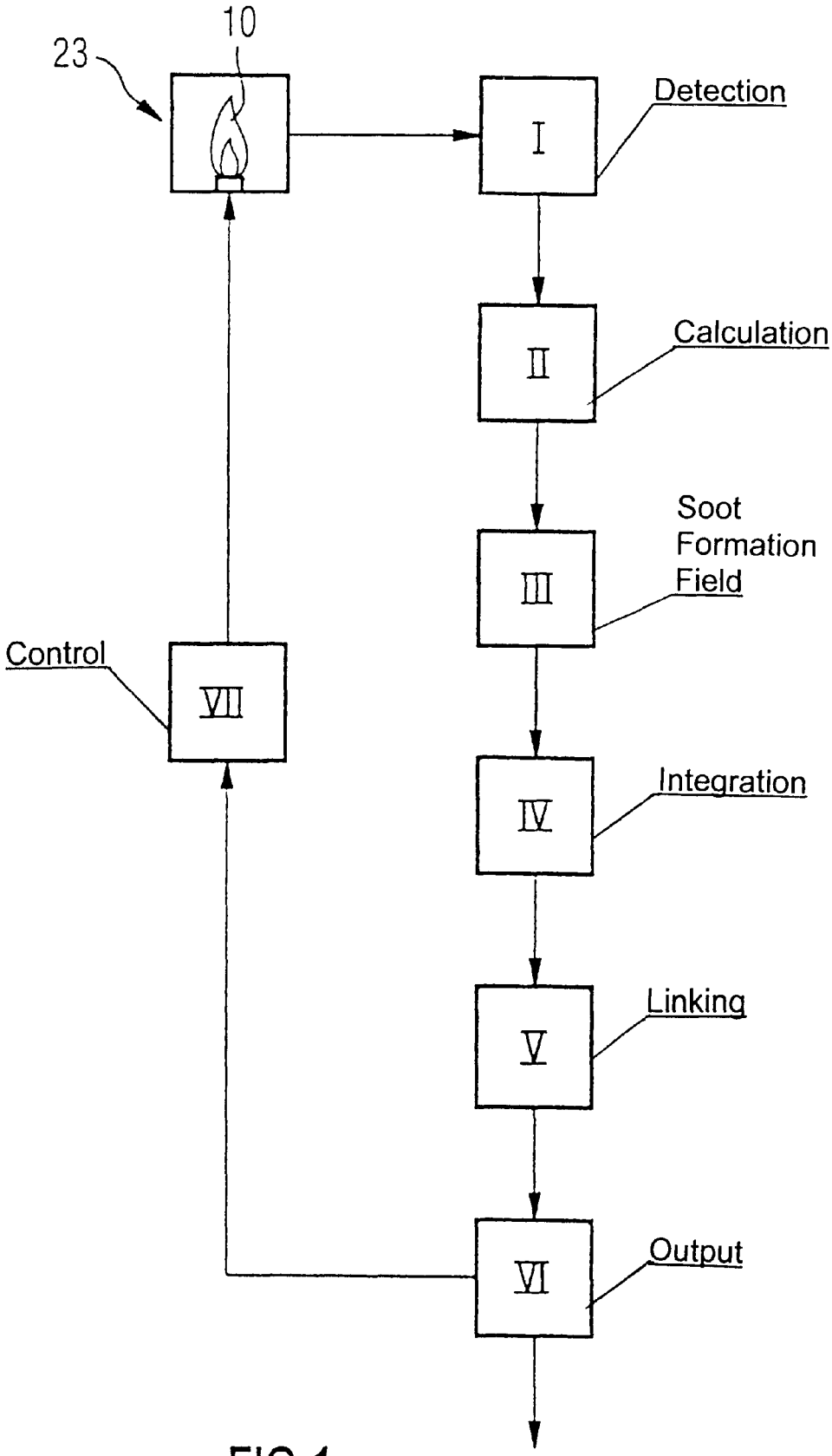
FIGS. 1 and 2 are process charts schematically illustrating the process of the method according to the invention.

Referring now to the figures of the drawings in detail and first, particularly, to FIG. 1 thereof, there is shown a schematic flowchart of the method according to the invention. A flame 10 in a combustion chamber 23 is monitored via a detecting device I. The detecting device I measures the spatial distribution of at least one parameter which is characteristic of combustion and permits an inference or conclusion concerning the soot charge or soot load. Either the temperature or the content of carbon monoxide are detected, or the temperature and carbon monoxide content are detected jointly. Subsequently, the local soot formation rate, which supplies a soot formation field III, is determined by calculating or by a comparison or calibration II. The soot formation field III is summed by integration IV and, if appropriate, averaged. Linking V to a calibration factor is subsequently performed. As a result, the soot charge in the combustion chamber is determined and is displayed, printed out or stored via a suitable output VI. The soot charge can additionally be passed to a controller VII which acts on the flame 10 and thus on the combustion. Firing control is achieved thereby.

Figure 2:
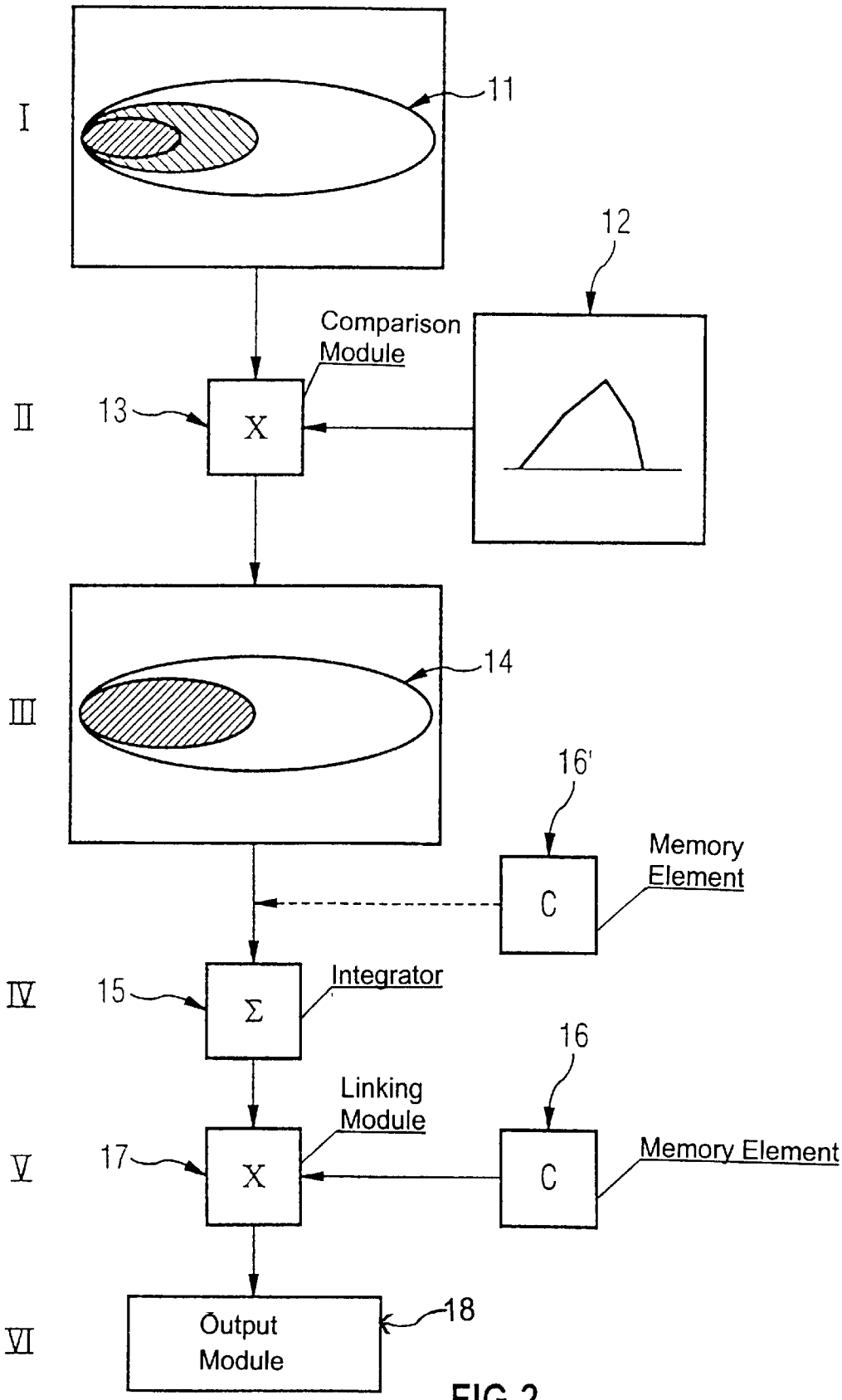

The method steps I to VI are illustrated more precisely in FIG. 2. The first step is to detect a temperature field 11 of the flame 10. The determination of the local soot charge on the basis of the temperature field 11 is performed by using a conversion curve 12 which has been determined by experiments, or has been calculated using physical and/or chemical relationships. Such conversion curves 12 are also printed in the VDI Heat Atlas and in "Technische Verbrennung" ["Technical Combustion"], Warnatz, Springer-Verlag [Warnatz, Springer-Publisher]. The temperature field 11 and the conversion curve 12 are linked in a comparison module 13 and supply a field 14 of the soot formation rate. This field 14 of the soot formation rate is transferred to an integrator 15 which undertakes spatial and/or temporal summing. If appropriate, averaging can also be carried out after the integration. The integration calculates the total soot formation rate, which is subsequently linked to a calibration factor 16 from a memory element C in a linking module 17. The soot charge is thereby calculated and is subsequently relayed to an output module 18.

Alternatively, it is possible to use another calibration factor 16', which is from another memory element C' and is linked to the field 14 of the soot formation rate after this field 14 has been determined. This is shown by dashes.

Figure 3:
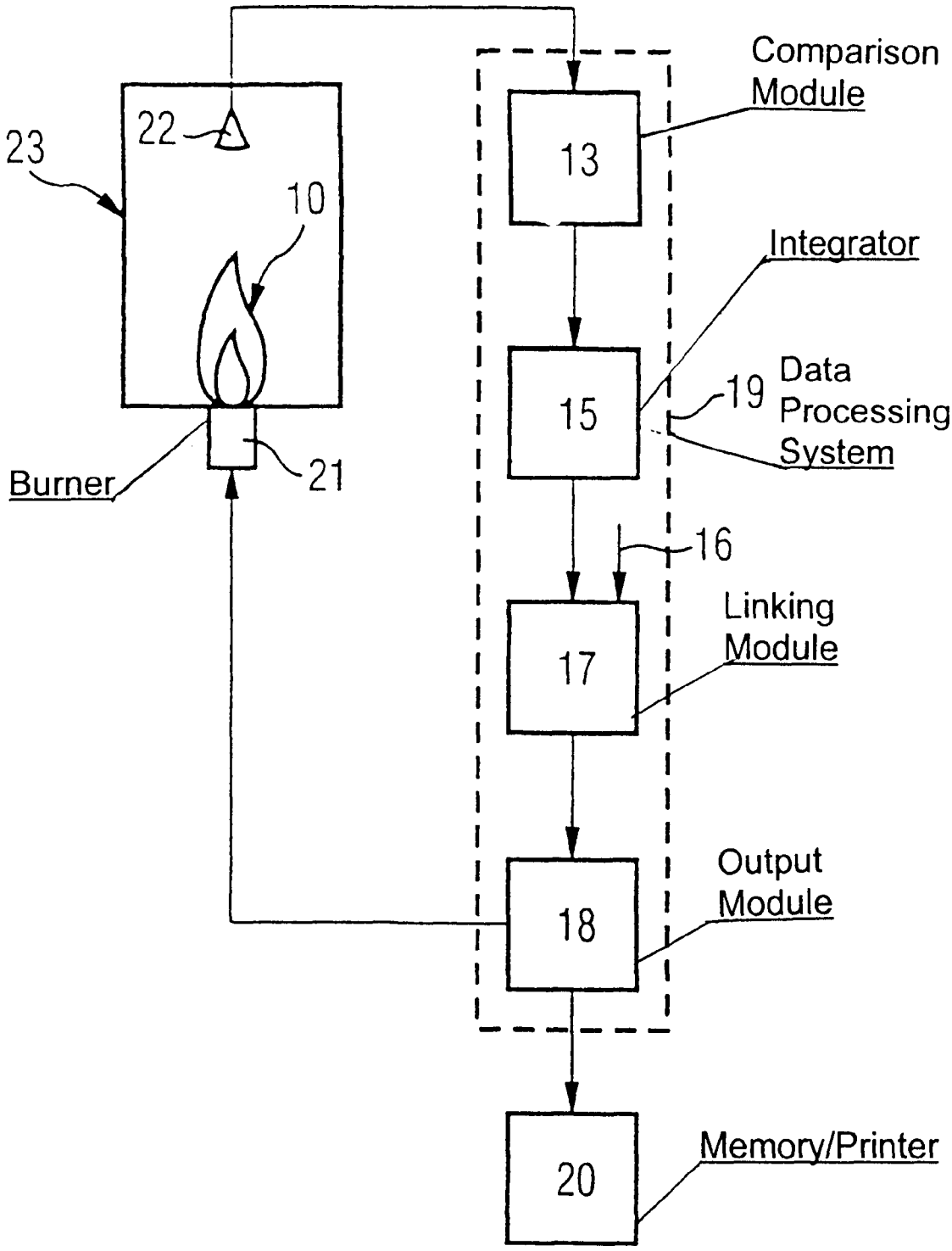
FIG. 3 is a block diagram of a device for carrying out the method according to the invention.

FIG. 3 shows a schematic of a device for carrying out the method according to the invention. The flame 10 in the combustion chamber 23 is fed by a burner 21. One or more sensors 22, which measure at least one parameter characteristic of a combustion, serve the purpose of monitoring. A CCD camera may be used for this purpose. It is advantageous to measure the spatial distribution of temperature and/or carbon monoxide content. The measured value is relayed to the comparison module 13, in which the field 14 of the soot formation rate is determined. The comparison module 13 transmits the field 14 of the soot formation rate to the integrator 15, in which the summing and, if appropriate, averaging is performed. Subsequently, the soot formation is determined in the linking module 17 via the calibration factor 16. This soot formation is output to the output module 18. The output module 18 transmits the soot charge to a printer or memory 20. Feedback to the burner 21 of the flame 10 is advantageously performed simultaneously. Firing control with direct, immediate monitoring of the flame 10, and thus very short dead times, is achieved thereby. The comparison module 13, the integrator 15, the linking module 17 and the output module 18 are combined in a data processing system 19.

Overall, the method according to the invention and the associated device permit a quick, simple and highly accurate determination of the soot charge.

We claim:

1. A method for determining a soot charge in a combustion chamber, the method which comprises:

measuring a spatial distribution of at least one parameter characteristic of a combustion by monitoring a flame in a combustion chamber, the at least one parameter allowing a conclusion concerning a soot charge in the combustion chamber during operation and the at least one parameter being at least one of a temperature and a carbon monoxide content; and determining the soot charge based on the measuring step and by using a comparison with given conversion curves.

2. The method according to claim 1, which comprises:

setting a permissible range having at least one of a lower limit and an upper limit for measured values of the at least one parameter characteristic of the combustion; and disregarding measured values outside the permissible range for the step of determining the soot charge.

3. The method according to claim 1, which comprises determining a local soot formation rate from a spatial distribution of at least one of the temperature and the carbon monoxide content.

4. The method according to claim 3, which comprises calculating the local soot formation rate by using a conversion curve which has been determined by experiments.

5. The method according to claim 3, which comprises summing the local soot formation rate in a measuring zone.

6. The method according to claim 5, which comprises averaging the local soot formation rate subsequent to the summing step.

7. The method according to claim 5, which comprises determining the soot charge on the basis of the local soot formation rate using a calibration factor prior to the summing step.

8. The method according to claim 7, which comprises providing the calibration factor as a variable calibration factor.

9. The method according to claim 8, which comprises providing the variable calibration factor as a function of at least one factor selected from the group consisting of a measured value and a combustion air fed to the flame.

10. The method according to claim 5, which comprises determining the soot charge on the basis of the local soot formation rate using a calibration factor subsequent to the summing step.

11. The method according to claim 3, which comprises summing the local soot formation rate during a given time interval.

12. The method according to claim 11, which comprises providing the given time interval as a variable time interval.

13. The method according to claim 11, which comprises averaging the local soot formation rate subsequent to the summing step.

14. The method according to claim 6, which comprises determining the soot charge on the basis of the local soot formation rate using a calibration factor prior to the summing step.

15. The method according to claim 14, which comprises providing the calibration factor as a variable calibration factor.

16. The method according to claim 15, which comprises providing the variable calibration factor as a function of at least one factor selected from the group consisting of a measured value and a combustion air fed to the flame.

17. The method according to claim 11, which comprises determining the soot charge on the basis of the local soot formation rate using a calibration factor subsequent to the summing step.

18. The method according to claim 1, which comprises measuring the temperature and the carbon monoxide content as two measured values and determining the soot charge on the basis of the two measured values.

19. A device for determining a soot charge in a combustion chamber, comprising:

at least one sensor for measuring a spatial distribution of at least one parameter characteristic of a combustion by monitoring a flame in a combustion chamber, the at least one parameter allowing a conclusion concerning a soot charge in the combustion chamber and the at least one parameter being at least one of a temperature and a carbon monoxide content; and data processing device operatively connected to said at least one sensor, said data processing device determining a soot formation rate based on the spatial distribution of the at least one parameter and based on a comparison with given conversion curves.

20. The device according to claim 19, wherein said at least one sensor is a CCD camera.

21. In combination with a combustion chamber having a soot charge during operation, a device for determining the soot charge, comprising:

at least one sensor configured for measuring a spatial distribution of at least one of a temperature and a carbon monoxide content in the combustion chamber by monitoring a flame in the combustion chamber; and a data processing device operatively connected to said at least one sensor, said data processing device determining a soot formation rate based on the spatial distribution of the at least one of the temperature and the carbon monoxide content and based on a comparison with given conversion curves.

* * * * *